US007284969B2

(12) United States Patent
Akimoto et al.

(10) Patent No.: US 7,284,969 B2
(45) Date of Patent: Oct. 23, 2007

(54) WASHER PUMP AND FILTER USED FOR WASHER PUMP

(75) Inventors: Shin Akimoto, Yokohama (JP); Daisuke Tanaka, Yokohama (JP)

(73) Assignee: Jidosha Denki Kogyo Co., Ltd., Yokohama-Shi, Kanagawa (JP)

( * ) Notice: Subject to any disclaimer, the term of this patent is extended or adjusted under 35 U.S.C. 154(b) by 744 days.

(21) Appl. No.: 10/668,341

(22) Filed: Sep. 24, 2003

(65) Prior Publication Data

US 2005/0063845 A1 Mar. 24, 2005

(51) Int. Cl.
*F04D 29/70* (2006.01)

(52) U.S. Cl. ..... 417/423.9; 415/121.2

(58) Field of Classification Search ..... 415/121.2; 417/423.9, 371

See application file for complete search history.

(56) References Cited

U.S. PATENT DOCUMENTS 3,871,796 A * 3/1975 Mack ..... 415/121.2
4,682,936 A * 7/1987 Suzuki et al. ..... 417/423.9
4,824,021 A 4/1989 Binder
5,184,946 A 2/1993 Sato
5,853,580 A 12/1998 Rusiñol et al.
6,293,769 B1 * 9/2001 Radermacher et al. ..... 417/371

FOREIGN PATENT DOCUMENTS

DE 37 30 567 A1 3/1989
JP 2-60659 5/1990

* cited by examiner

*Primary Examiner*—Michael Koczo, Jr.
(74) *Attorney, Agent, or Firm*—McGinn IP Law Group, PLLC

(57) ABSTRACT

A washer pump includes a case partitioned into a motor chamber, which accommodates an armature rotated when it is electrically energized, and partitioned into a pump chamber, which accommodates an impeller rotated being coupled to an armature shaft of the armature, wherein washing liquid is sucked into the pump chamber from a liquid suction port, which is communicated with the pump chamber, by the rotation of the impeller, and the washing liquid is discharged from a liquid discharge port which is communicated with the pump chamber, and the washer pump is characterized in that: a ventilation hole is provided on a partition wall to partition the pump chamber and the liquid suction port, a filter for filtering the washing liquid is detachably attached to the liquid suction port, an air passage is provided in the filter, and the air passage is communicated with the ventilation hole.

18 Claims, 9 Drawing Sheets

A-A

B-B

C-C

WASHER PUMP AND FILTER USED FOR WASHER PUMP

BACKGROUND OF THE INVENTION

1. Field of the Invention

The present invention relates to a washer pump for sucking washing liquid stored in a washer tank and injecting it from a nozzle. The present invention also relates to a filter used for the washer pump.

2. Related Art

This type washer pump is disclosed in Japanese Utility Model Publication No. H02-60659U shown in FIGS. 13 and 14. As shown in FIG. 13, this washer pump 1 is attached via the cylindrical communicating member 6, the outer circumference of which is engaged with the liquid discharge port 5*b* formed on the side wall 5*a* of the washer tank 5. The pump case 2 of this washer pump 1 includes: a motor chamber 2*a* accommodating the armature 3 rotating when electricity is supplied to it; and a pump chamber 2*b* accommodating the impeller 4 rotating being coupled to the armature shaft 3*a* of the armature 3. The cylindrical liquid suction port 2*c* communicating with the pump chamber 2*b* is inserted into the inner circumference of the communicating member 6. As shown in FIG. 14, the filter 7 for filtering washing liquid W is arranged in the communicating member 6.

When a predetermined intensity of electric power is supplied from the connector 2*e* for supplying electric power to the washer pump 1 via a switch not shown in the drawing, the armature 3 is rotated and the impeller 4 is rotated in the pump chamber 2*b*. When the impeller 4 is rotated, washing liquid W stored in the washer tank 5 is sucked from the liquid suction port 2*c* into the pump chamber 2*b*. At the same time, washing liquid W is discharged from the liquid discharge port 2*d* communicated with the pump chamber 2*b*. Washing liquid W, which has been discharged from the liquid discharge port 2*d*, is supplied to the nozzle 9 flowing in the liquid supply pipe 8 and injected from the nozzle 9 to a washing face not shown in the drawing.

While washing liquid W is being sucked from the liquid discharge port 5*b* of the washer tank 5 into the liquid suction port 2*c* of the washer pump 1 via the communicating member 6, foreign objects such as dust are removed and filtered by the mesh-like filtering portion 7*a* of the filter 7 provided in the communicating member 6. Therefore, no foreign objects are sucked into the pump chamber 2*b* of the washer pump 1. Due to the foregoing, the occurrence of damage of the impeller in the pump chamber 2*b* caused by the mixed foreign objects can be prevented. Also, the occurrence of blinding of the nozzle 9 can be prevented.

However, in the case of the aforementioned conventional washer pump 1, a centrifugal type washer pump is adopted, the suction pressure of which is so low that the sucking operation cannot be performed. Therefore, when the washer pump 1 is operated, it is impossible for the centrifugal type washer pump to let air out of the pump chamber 2*b* so as to reduce the pressure in the pump chamber 2*b* to be negative. Therefore, the impeller 4 is idly rotated, and it is impossible to discharge washing liquid W from the liquid discharge port 2*d* of the pump chamber 2*b*. Especially in the case where the mesh-like filtering portion 7*a* is arranged in the communicating member 6 or a check valve is arranged in the liquid supply pipe 8 for communicating the pump chamber 2*b* with the nozzle 9 is arranged, when washing liquid W is poured into the washer tank 5, a water film formed on the filter 7 by the action of surface tension can not be torn away even when the washer pump 1 is operated, and the impeller 4 is idly rotated and washing liquid W can not be discharged from the liquid discharge port 2*d* of the pump chamber 2*b*. In the conventional washer pump, this phenomenon remarkably appears.

SUMMARY OF THE INVENTION

The present invention has been accomplished to solve the above problems. It is an object of the present invention to provide a washer pump and a filter, which is used for the washer pump, characterized in that: even if a water film is formed on the filter, the water film on the filter is torn away by letting air out from a pump chamber so as to make the pressure in the pump chamber negative and washing liquid is sucked into the pump chamber and positively discharged out from a liquid discharge port.

(1) The invention provides a washer pump comprising:

a case which is partitioned into a motor chamber and a pump chamber;

an armature accommodated in the motor chamber, the armature having an armature shaft rotatable when the armature is electrically energized;

an impeller accommodated in the pump chamber and coupled to the armature shaft so as to be rotatable;

a liquid suction port communicating with the pump chamber from which washing liquid is sucked into the pump chamber by a rotation of the impeller;

a liquid discharge port communicating with the pump chamber from which the washing liquid is discharged; and a filter detachably attached in the liquid suction port for filtering the washing liquid, wherein a ventilation hole is formed on a partition wall between the pump chamber and the liquid suction port, so that an air passage communicating with the ventilation hole is provided in the filter.

(2) The invention provides a washer pump, wherein the filter is provided with a filter body having a cylindrical circumferential wall and a bottom wall, each of the bottom wall and the circumferential wall of the filter body being formed with mesh-like filtering portions, and a part of the circumferential wall is formed into a duct portion functioning as an air passage extending in the longitudinal direction of the filter.

(3) The invention provides a washer pump, wherein the duct portion is extended from an opening side of the filter so as to horizontally protrude from the bottom wall, and a cutout portion formed on a bottom face of the duct portion at a rear side thereof is made to closely come into contact with an attachment portion having flat faces in a stepped manner in the liquid suction port.

In the washer pump of the invention, even when a water film is formed on the filter, air is let out from the pump chamber via the air passage, and the pressure in the pump chamber is reduced to be negative. Therefore, the water film on the filter is torn away. Due to the foregoing, washing liquid is sucked into the pump chamber and positively discharged out from the liquid discharge port.

(4) Further, the invention provides a filter adapted to be installed in a washer pump including a case partitioned into a motor chamber which accommodates an armature having an armature shaft that is rotatable when the armature is electrically energized, and a pump chamber which accommodates an impeller that is coupled to the armature shaft of the armature so as to be rotatable, wherein washing liquid is sucked into the pump chamber from a liquid suction port, which is communicated with the pump chamber by the rotation of the impeller, and the washing liquid is discharged from a liquid discharge port which is communicated with the pump chamber;

wherein a filter body for filtering the washing liquid is detachably attached to the liquid suction port, an air passage is provided in the filter body, so that the air passage is communicated with a ventilation hole provided on a partition wall for partitioning the pump chamber and the liquid suction port.

(5) The present invention provides a filter used for a washer pump, wherein the filter body includes a substantially cylindrical circumferential wall and a bottom wall, each of the circumferential wall and the bottom wall being formed into a mesh-like filtering portion, and a part of the circumferential wall is formed into a duct portion functioning as an air passage extending in the longitudinal direction of the filter.

(6) The present invention provides a filter used for a washer pump, wherein the duct portion is extended from an opening side of the filter so as to horizontally protrude from the bottom wall, and a cutout portion formed on a bottom face of the duct portion at a rear side thereof is made to closely come into contact with an attachment portion having flat faces in a stepped manner in the liquid suction port.

According to the filter of the invention, even when a water film is formed on the filter body, air is let out from the pump chamber in the washer pump to the outside of the pump chamber via the ventilation hole and the air passage. Therefore, the pump chamber is set into a state of negative pressure, and the water film formed on the filter body is torn away. Due to the foregoing, washing liquid is sucked from the pump chamber and positively discharged out from the liquid discharge port.

DETAILED DESCRIPTION OF THE PREFERRED EMBODIMENTS

Figure 1:
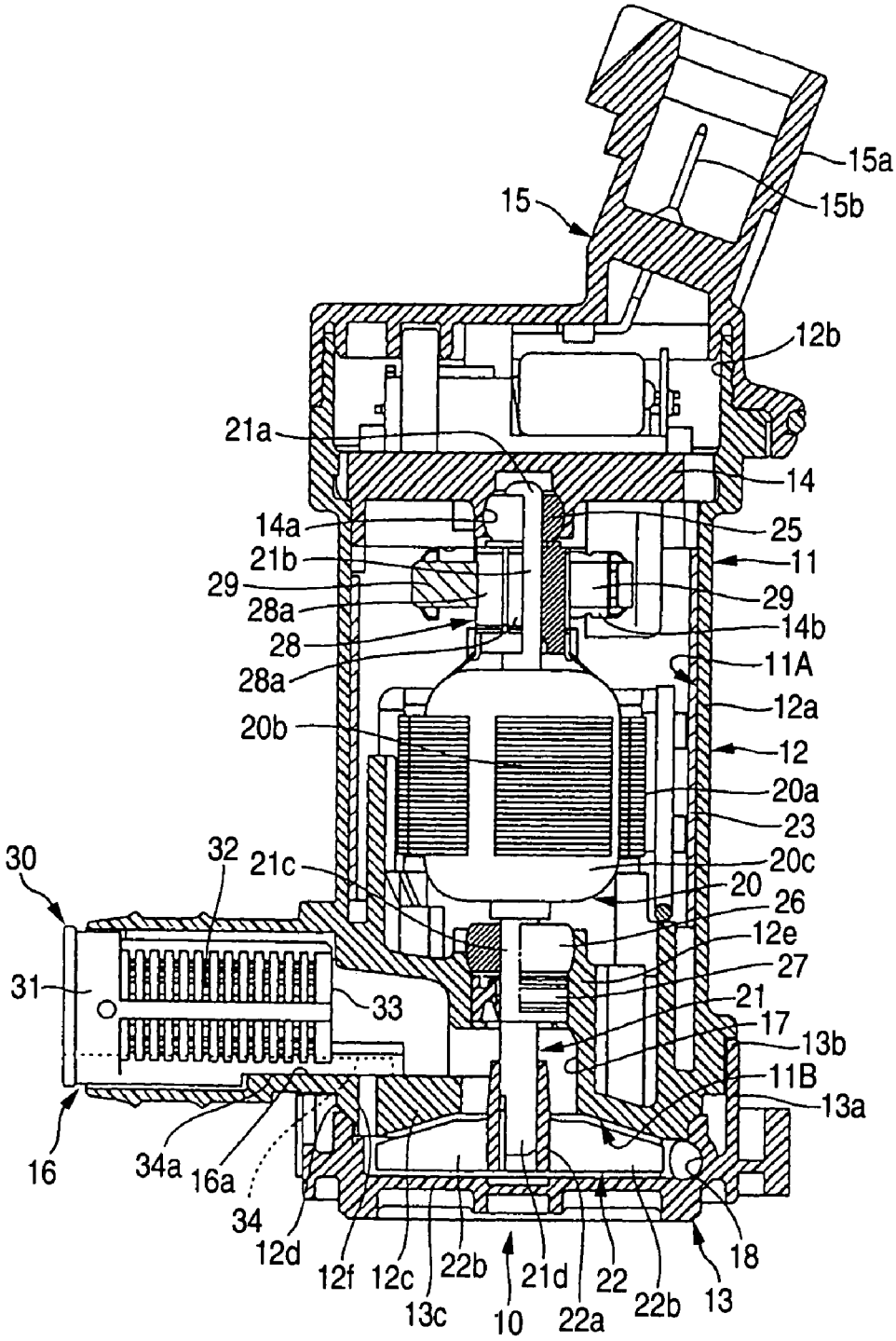
FIG. 1 is a sectional view taken on line A-A in FIG. 3 showing a washer pump of an embodiment of the present invention.

Referring to the drawings, an embodiment of the present invention will be explained below.

Figure 2:
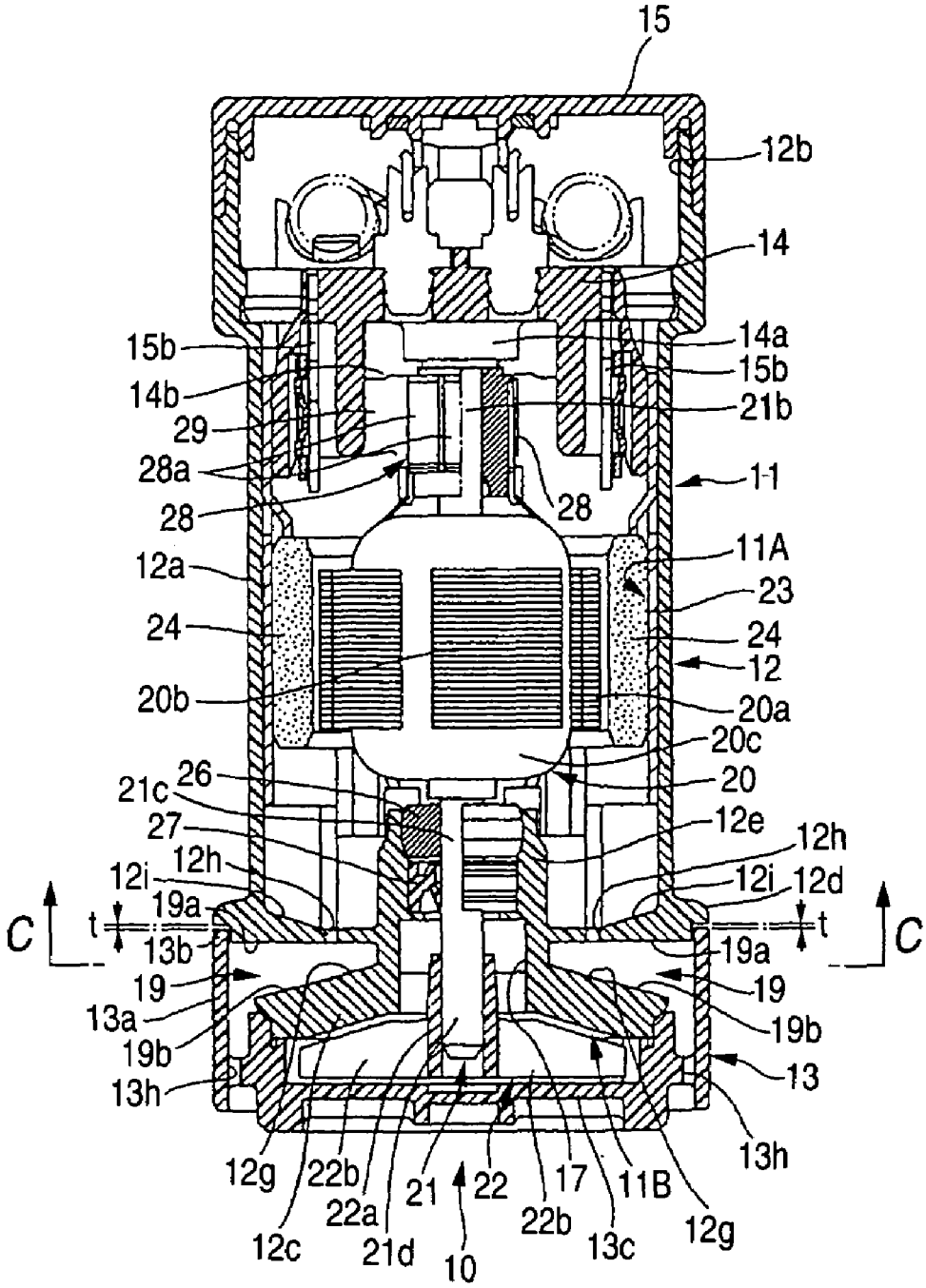
FIG. 2 is a sectional view taken on line B-B in FIG. 3.
Figure 3:
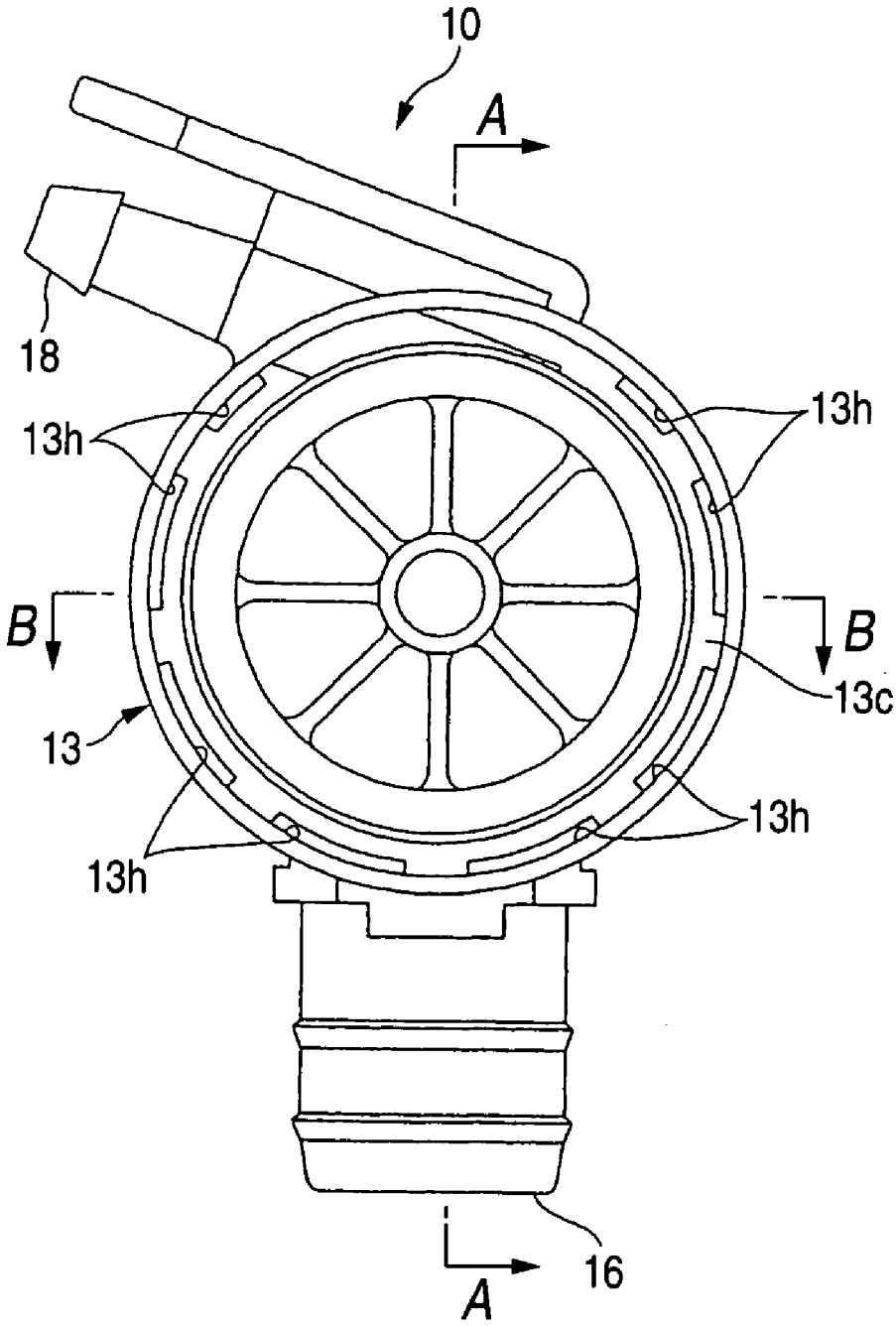
FIG. 3 is a bottom view of the washer pump.
Figure 4:
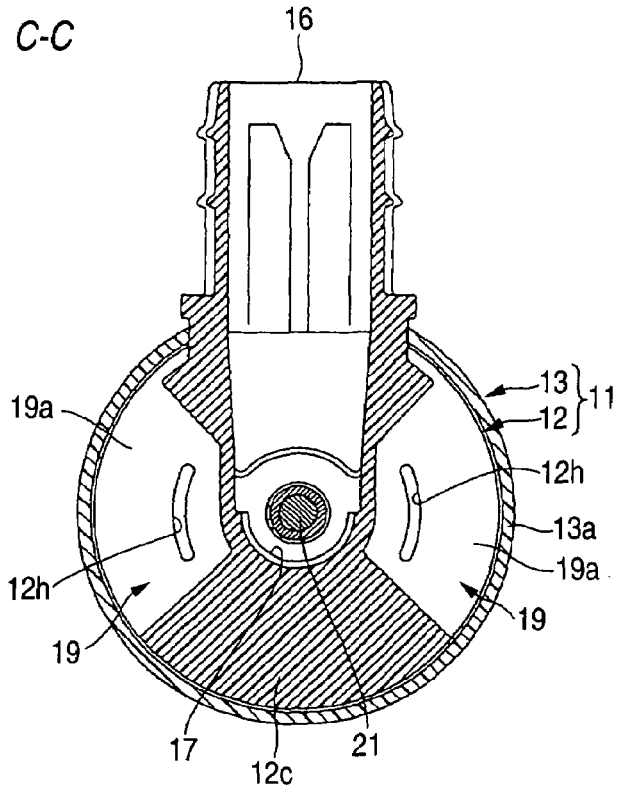
FIG. 4 is a sectional view taken on line C-C in FIG. 2.
Figure 5:
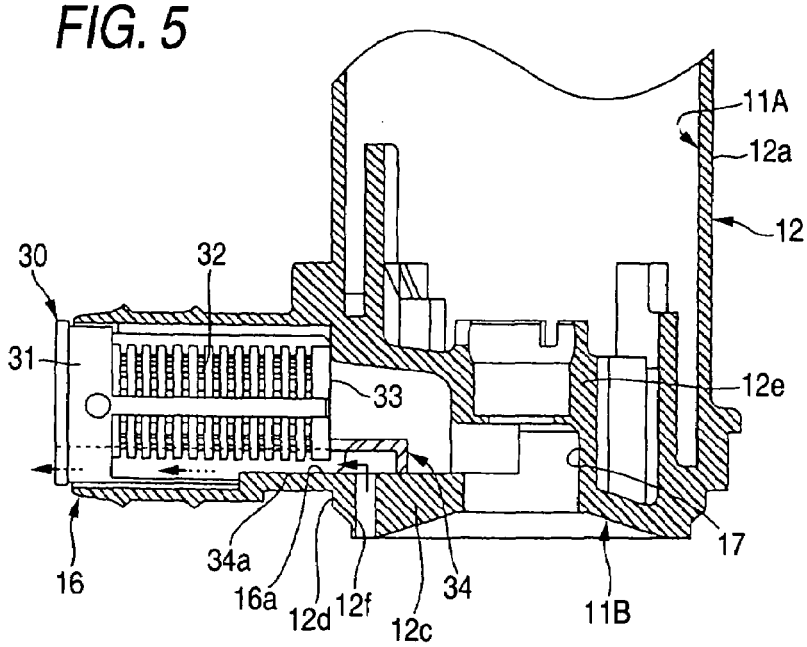
FIG. 5 is a longitudinal sectional view of a liquid sucking portion of the washer pump.
Figure 6:
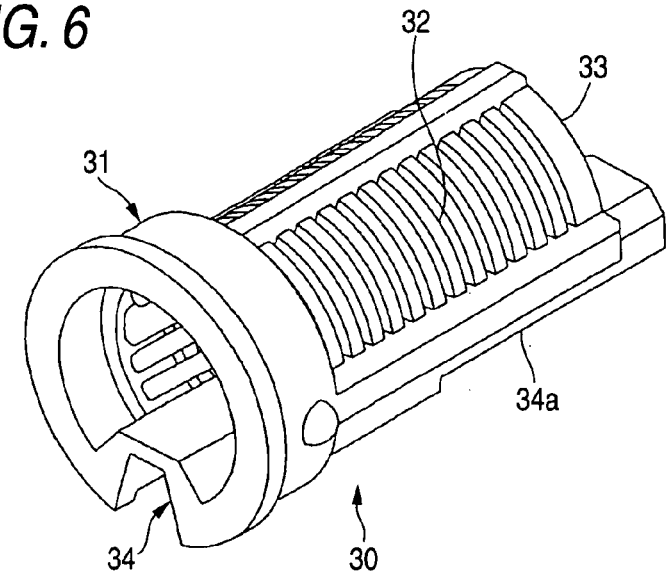
FIG. 6 is a perspective view of the filter used for the washer pump.
Figure 7:
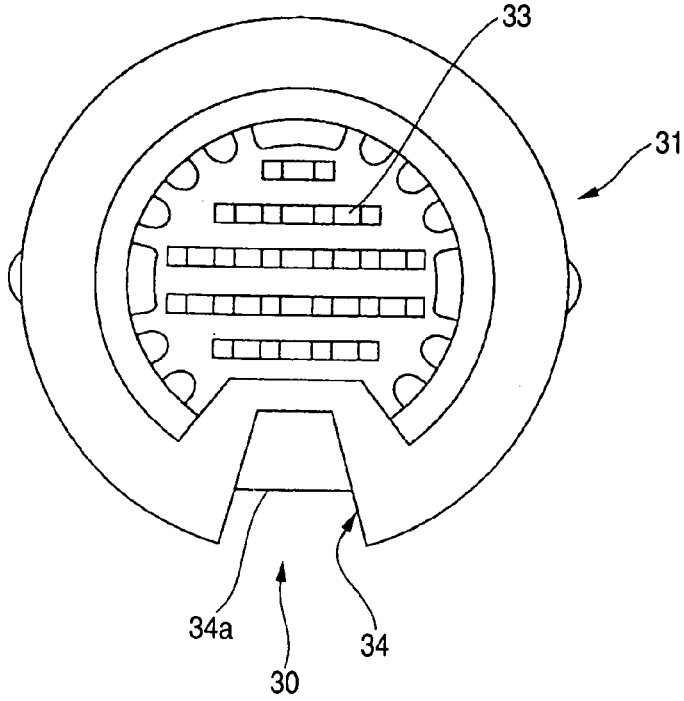
FIG. 7 is a front view of the filter.
Figure 8:
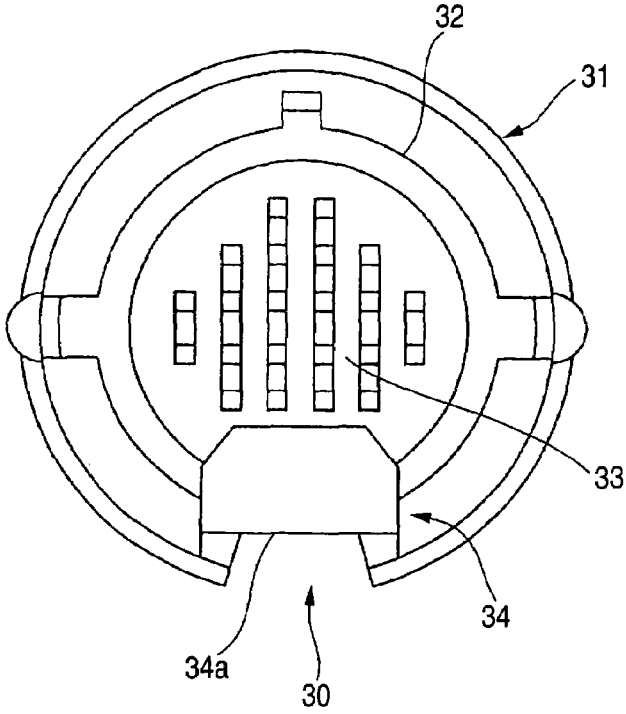
FIG. 8 is a rear view of the filter.
Figure 9:
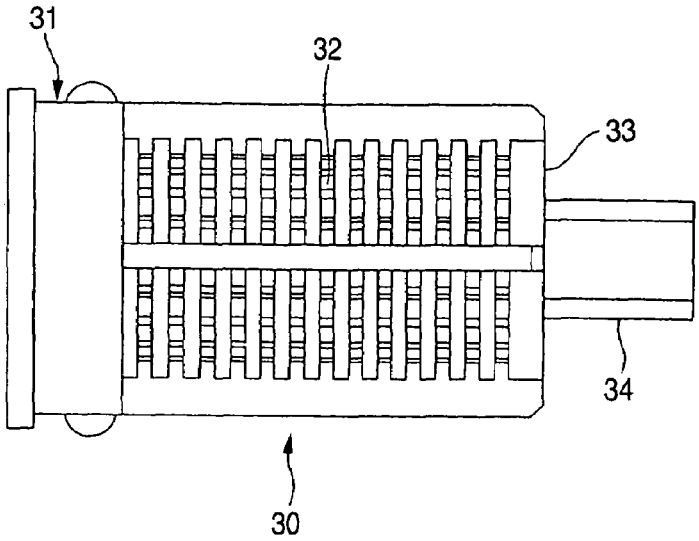
FIG. 9 is a plan view of the filter.
Figure 10:
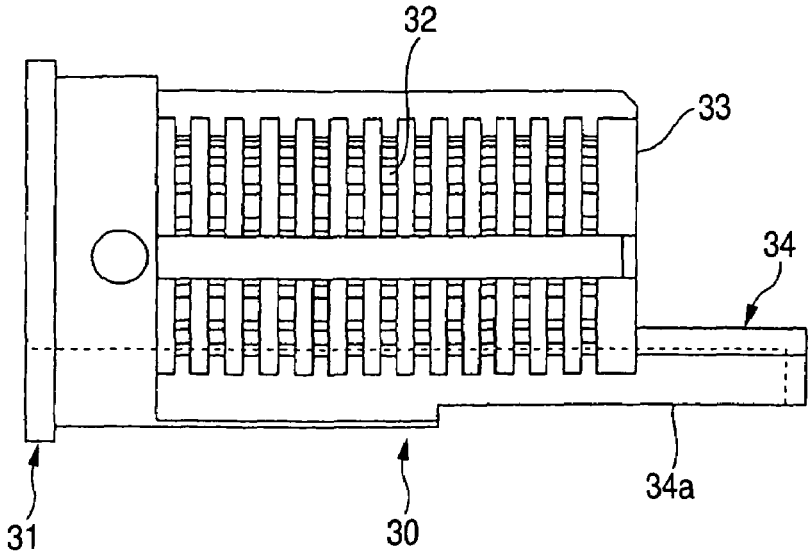
FIG. 10 is a side view of the filter.
Figure 11:
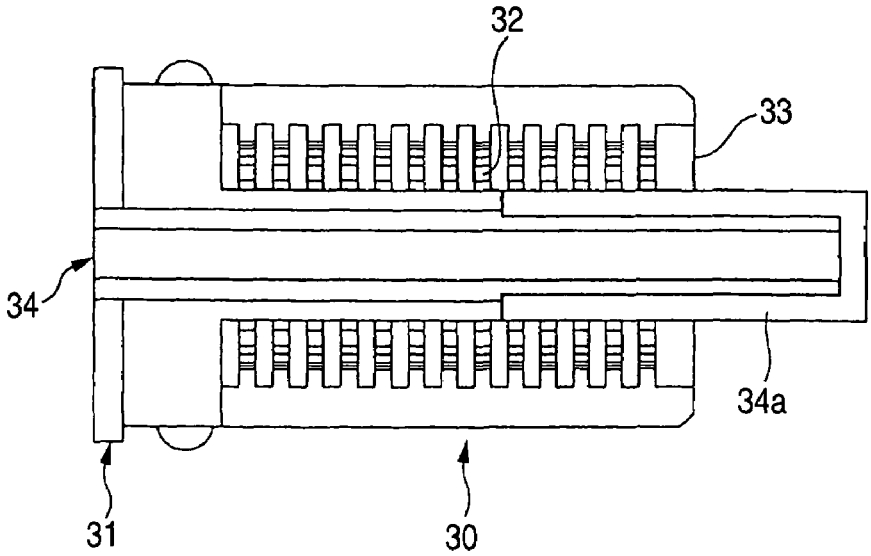
FIG. 11 is a bottom view of the filter.
Figure 12:
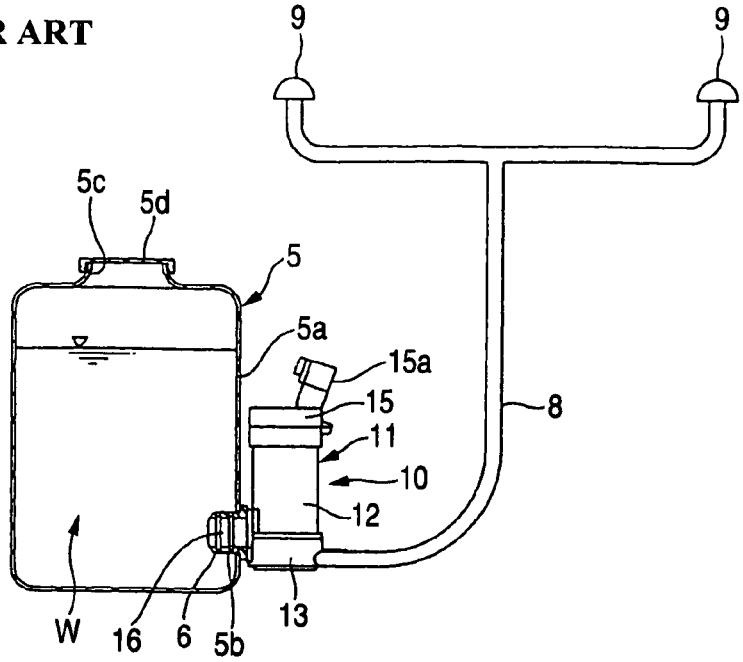
FIG. 12 PRIOR ART
FIG. 12 is a schematic illustration showing a state in which the washer pump is attached.
Figure 13:
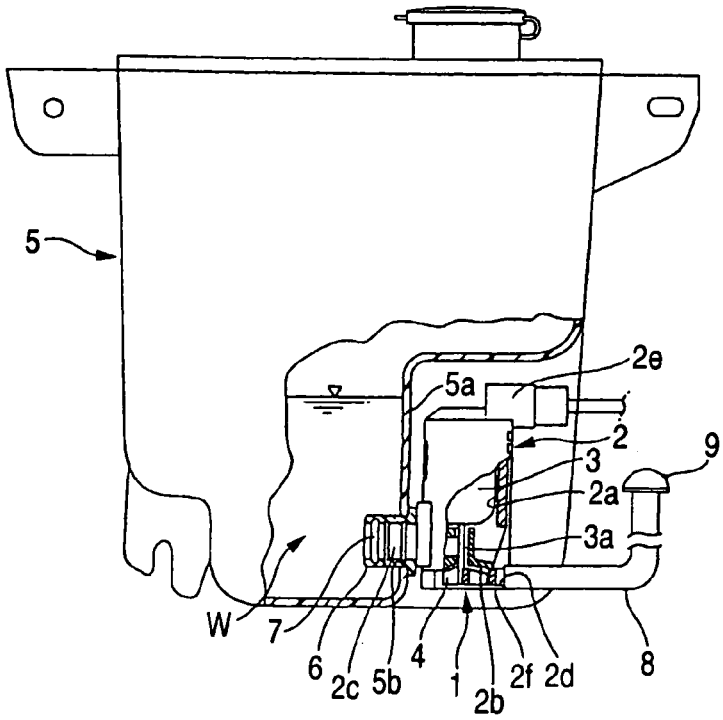
FIG. 13 PRIOR ART
FIG. 13 is a sectional side view showing a primary part of the conventional washer pump.
Figure 14:
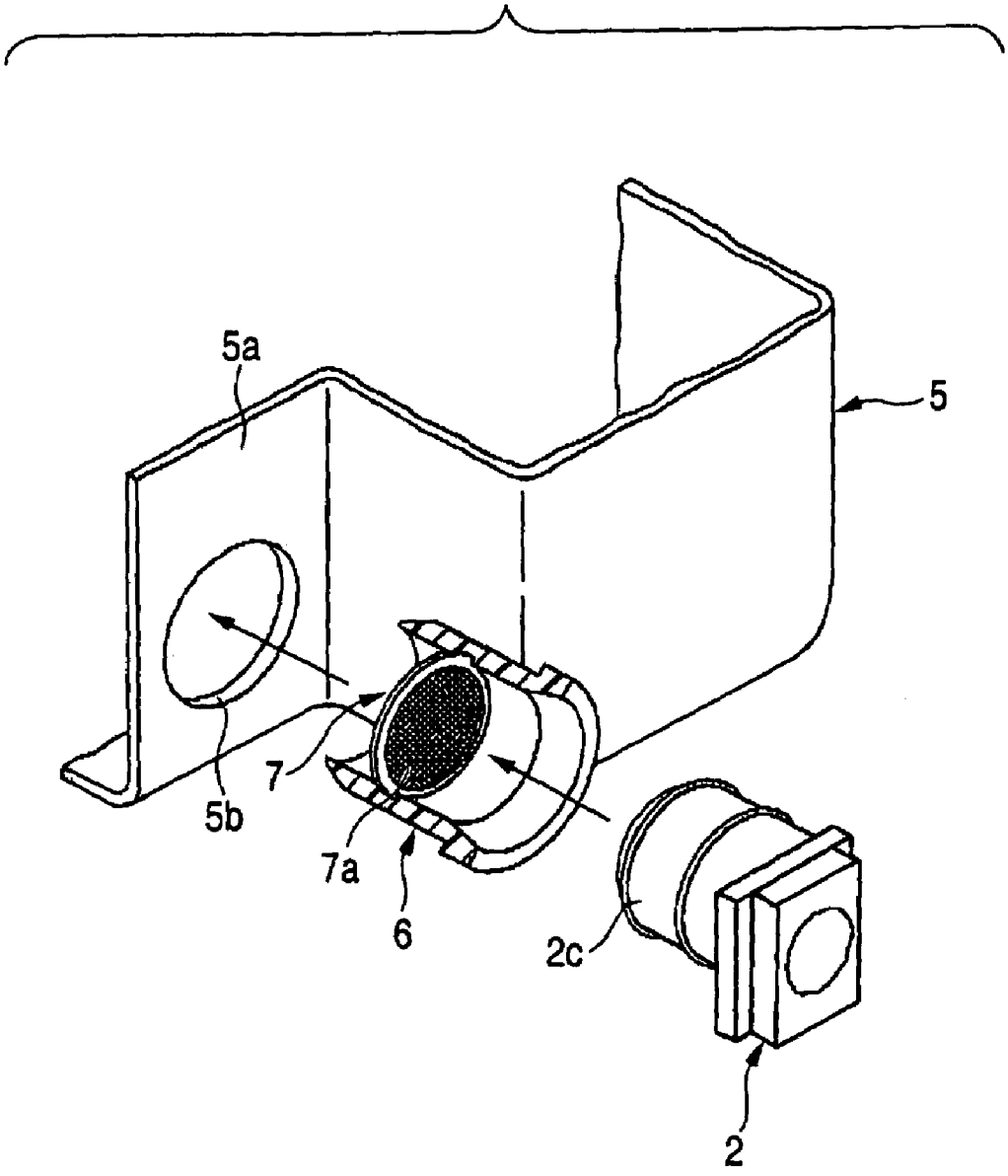
FIG. 14 PRIOR ART
FIG. 14 is a partial perspective view showing a primary part of the conventional washer pump.

FIG. 1 is a sectional view taken on line A-A in FIG. 3 showing a washer pump of an embodiment of the present invention, FIG. 2 is a sectional view taken on line B-B in FIG. 3, FIG. 3 is a bottom view of the washer pump, FIG. 4 is a sectional view taken on line C-C in FIG. 2, FIG. 5 is a longitudinal sectional view of a liquid sucking portion of the washer pump, FIG. 6 is a perspective view of the filter used for the washer pump, FIG. 7 is a front view of the filter, FIG. 8 is a rear view of the filter, FIG. 9 is a plan view of the filter, FIG. 10 is a side view of the filter, FIG. 11 is a bottom view of the filter, and FIG. 12 is a schematic illustration showing a state in which the washer pump is attached.

As shown in FIGS. 1, 2 and 12, the washer pump 10 is attached via the cylindrical communicating member 6 made of synthetic resin, the outer circumference of which is engaged with the liquid discharge port 5*b* formed on the side wall 5*a* of the washer tank 5 made of synthetic resin. The case 11 of the washer pump 10 includes: a motor chamber 11A, which accommodates an armature 20 rotated when it is electrically energized; and a pump chamber 11B, which accommodates an impeller 22 rotated being coupled to an armature shaft 21 of the armature 20. Washing liquid W is sucked into the pump chamber 11B from a liquid suction port 16, which is communicated with the pump chamber 11B, by the rotation of the impeller 22, and washing liquid W is discharged from a liquid discharge port 18 which is communicated with the pump chamber 11B. Washing liquid W discharged from the liquid discharge port 18 is supplied to a pair of nozzles 9, 9 when it flows in the liquid supply pipe 8 and injected to a washing face not shown from the pair of nozzles 9, 9.

As shown in FIGS. 1 and 2, the case 11 includes: a cylindrical pump case 12 made of synthetic resin forming the motor chamber 11A inside the peripheral wall 12*a*, the upper face of which is open; a pump cover 13 made of synthetic resin, the cross section of which is a substantial U-shape, fixed to the outer circumferential portion 12*d* of the bottom wall (partition wall) of the pump case 12, for example, by means of welding, the pump chamber 11B being formed inside the pump cover 13; and a motor cover 14 made of synthetic resin engaged with the inner circumference of the opening portion 12*b* of the pump case 12. The connector 15 for supplying electric power made of synthetic resin is engaged with the outer circumference of the opening portion 12*b* of the pump case 12.

On the inner circumferential face of the circumferential wall 12*a* of the pump case 12, the cylindrical yoke 23 made of metal is fixed. On the inner circumferential face of this yoke 23, the magnet 24 is fixed, for example, by fixing means such as a spring or additive. Between the bearing 25 engaged with the spherical recess portion 14*a* at the center of the motor cover 14 and the bearing 26 engaged with the spherical inner circumferential face of the cylindrical portion 12*e* at the center of the bottom wall 12*c* of the pump case 12, the upper end portion 21*a* and the lower portion 21*c* of the armature shaft 21 are respectively pivotally supported. A portion between the cylindrical portion 12*e* at the center of the bottom wall 12*c* of the pump case 12 and the lower portion 21*c* of the armature shaft 21 is sealed by the annular seal body 27. The motor chamber 11A is water-tightly kept from the pump chamber 11B by this seal body 27.

The armature 20 is attached at a position opposed to the magnet 24 of the armature shaft 21. This armature 20 includes: an armature core 20*a* fixed at the substantial center of the armature shaft 21 in the axial direction, having the coil winding portion 20*b*, the number of slots of which is predetermined; and an armature coil 20*c* which is wound round the coil winding portion 20*b* of the armature coil 20*a*.

The commutator 28 is fixed to the upper portion 21*b* of the armature shaft 21. This commutator 28 is provided with the commutator pieces 28*a*, the number of which is the same as that of the coil winding portion 20*b* of the armature core 20*a*. Each commutator piece 28*a* and the armature coil 20*c* are electrically connected with each other.

At a position on the motor cover 14 opposed to the commutator 28, a pair of brush holders 14*b*, 14*b* are fixed. The brush 29 is attached to each brush holder 14*b*. Each brush 29 is electrically connected with a washer circuit not shown via a pair of terminals 15*b*, 15*b* of the connector 15 for supplying electric power. When a washer switch not shown is turned on, an electric current flows to the armature 20 via the pair of terminals 15*b*, 15*b*, which extend into the connector attaching portion 15*a* of the connector 15 for supplying electric power, and via each brush 29 and the commutator piece 28*a*. Therefore, the armature shaft is normally rotated.

The cylindrical portion 22*a* of the impeller 22 is combined with the lower end portion 21*d* of the armature shaft 21 in such a manner that the cylindrical portion 22*a* of the impeller 22 can not be relatively rotated in the circumferential direction with respect to the armature shaft 21 but can be slid in the axial direction. On the outer circumference of this cylindrical portion 22*a*, there are provided a plurality of blades 22*b* in the radial direction at regular intervals in such a manner that the plurality of blades 22*b* protrude from the outer circumference being integrated into one body.

As shown in FIGS. 1, 5 and 12, on the bottom wall 12*c* of the circumferential wall 12*a* of the pump case 12, there is provided a cylindrical liquid suction port 16 which protrudes from the bottom wall 12*c* being integrated into one body. When this cylindrical liquid suction port 16 is inserted into the inner circumference of the cylindrical communicating member 6 of the washer tank 5, the washer pump 10 can be attached to the washer tank 5. The liquid suction port 16 is communicated with the pump chamber 11B via the hole-shaped liquid introducing portion 17 formed at the center of the bottom wall 12*c*. Further, as shown in FIGS. 1 and 5, in the periphery (on the circumferential wall 12*a* side) of the outer circumferential edge of the bottom wall 12*c*, which is a partition wall to partition the pump chamber 11B and the motor chamber 11A, the ventilation hole 12*f*, which is a hole for letting air out, is formed so that it penetrates in the axial direction (the upward and downward direction). The liquid suction port 16 and the pump chamber 11B are also communicated with each other by this ventilation hole 12*f*.

As shown in FIGS. 2 and 4, at the central portion in the axial direction (the upward and the downward direction) of the bottom wall 12*c*, which is a partition wall to partition the motor chamber 11A and the pump chamber 11B, there are provided a plurality of chambers 19 which are arranged in the circumferential direction at regular intervals. In this embodiment, there are provided a pair of chambers 19, 19 which are arranged at positions symmetrical to each other in the circumferential direction. That is, the recess portions 12*g*, 12*g* are respectively formed at positions symmetrical to each other in the circumferential direction toward the inside from the central portion in the axial direction of the outer circumferential edge of the outer circumference 12*d* of the bottom wall 12*c*. By the pair of recess portions 12*g*, 12*g* and the circumferential wall 13*a* of the pump cover 13, the chambers 19, 19 are respectively formed. As shown in FIGS. 2 and 4, on the bottom wall 12*c* of the pump case 12 inside the upper face 19*a* of each chamber 19, the inside ventilation hole 12*h* communicating with the motor chamber 11A is formed so that it penetrates in the axial direction (the upward and the downward direction). As shown in FIGS. 2 and 3, in the outer circumferential portion of the bottom wall 13*c* of the pump cover 13, which is located at a position lower in the axial direction than the outer circumferential edge of the bottom wall 12*c* of the lower face 19*b* of each chamber 19, there are provided a plurality of outside ventilation holes 13*h* communicating with the outside air which are arranged in the circumferential direction at regular intervals.

Further, as shown in FIG. 2, on the lower face 19*b* of each chamber 19, there is provided a conical inclination face in such a manner that a distance of the conical inclination face from the upper face 19*a* of the chamber is increased as it comes to the outer circumference of the bottom wall 12*c*. The upper face 12*i* of the bottom wall 12*c* of the upper face 19*a* of the chamber is formed into a conical inclination face which inclines upward in the axial direction (the upward and the downward direction) as it comes to the outer circumference from the central portion in the radial direction. By this upper face 12*i*, water staying in the motor chamber 11A can be positively discharged outside from the inside air communicating hole 12*h* via the inclined lower face 19*b* of each chamber 19 and the outside ventilation hole 13*h*.

As shown in FIG. 2, there is provided a gap t between the outer circumferential portion 12*d* of the bottom wall 12*c* of the pump case 12 and the forward end portion 13*b* of the circumferential wall 13*a* of the pump cover 13.

Further, as shown in FIGS. 1 and 3, at the position opposed to the liquid suction port 16 of the circumferential wall 13*a* of the pump cover 13, the cylindrical liquid discharge port 18 is integrally formed being protruded. This cylindrical liquid discharge port 18 is communicated with each nozzle 9 via the liquid supply pipe 8.

As shown in FIGS. 1 and 5, the filter 30 for filtering the washing liquid W is detachably attached in the liquid suction port 16 of the pump case 12. This filter 30 is provided with a filter body 31 made of synthetic resin, which is attached to the liquid suction port 16, for filtering the washing liquid W flowing in the liquid suction port 16. As shown in FIGS. 5 to 11, the filter 31 is formed into a substantial cylinder having a bottom. The circumferential wall 32 and the bottom wall 33 are formed into a mesh-like filtering portion for filtering foreign objects such as dust contained in the washing liquid W. A part of the circumferential wall 32 is formed into a semi-cylindrical (reverse-V-shaped groove) duct portion (air passage) 34 extending in the longitudinal direction. As shown in FIGS. 1 and 51 this duct portion 34 extends so that it protrudes horizontally from the opening side of the filter body 31 to the outside of the bottom wall 33. When the filter body 31 is attached to the liquid suction port 16 of the pump case 12; the cutout portion 34*a* of the bottom face of the rear portion of the duct portion 34 closely comes into contact with an attachment portion 16*a* having flat faces in a stepped manner in the cylindrical liquid suction port 16, and the rear end portion of the duct portion 34 is tightly communicated with the vertical ventilation hole 12*f* which is formed penetrating the bottom wall 12*c* for partitioning the pump chamber 11B and the liquid suction port 16. Due to the foregoing, as shown by the arrows in FIG. 5, air is injected into the washer tank 5 from the pump chamber 11B flowing from the ventilation hole 12*f* in the duct portion 34 so as to let out the air from the pump chamber 11B.

In this connection, as shown in FIG. 12, the washing liquid pouring port 5*c* of the washer tank 5 is covered with the lid 5*d* made of synthetic resin.

According to the washer pump 10 of the above embodiment, when washing liquid W is poured from the washing liquid pouring port 5*c* into the washer tank 5, a water film is formed on the circumferential wall 32 and the bottom wall 33 which are a mesh-like filtering portion of the filter 30. Due to the water film formed on the filter 30, no washing liquid W enters the pump chamber 11B. Therefore, the pump chamber 11B is filled with air.

When an electric current generated by a predetermined electric power source is supplied from the connector 15 for supplying electric power via a switch not shown to the armature 20 of the washer pump 10, the armature 20 is rotated. By the rotation of the armature 20, in the pump chamber 11B of the washer pump 10, the impeller 22, which is coupled to the armature shaft 21 in such a manner that the impeller 22 and the armature shaft 21 can not be mutually rotated with each other, is rotated. Therefore, positive air pressure is given to the outer circumferential portion of the pump chamber 11B. Due to the foregoing, as shown by the arrows in FIG. 5, air is injected into the washer tank 5 from the pump chamber 11B flowing from the ventilation hole 12*f* of the pump case 12 in the duct portion 34 of the filter 30. Due to this injection of air, the pump chamber 11B is set into a state of negative pressure.

By the action of negative pressure, a water film formed on the circumferential wall 32 and the bottom wall 33, which are a mesh-like filtering portion of the filter 30, is torn away, and washing liquid W enters the pump chamber 11B. Then, by the plurality of blades 22*b* of the impeller 4 rotated by the armature 20, washing liquid W stored in the washer tank 5 is sucked from the liquid suction port 16 into the pump chamber 11B via the liquid introducing portion 17 and discharged from the liquid discharge port 18 communicating with the pump chamber 11B. Washing liquid W discharged from the liquid discharge port 18 is sent to the nozzle 9, flowing in the liquid supply pipe 8 and injected from the nozzle 9 to a washing face.

While the washing liquid w is being sucked from the liquid supply port 5*b* of the washer tank 5 into the liquid suction port 16 of the washer pump 10 via the communicating member 6, foreign objects such as dust can be filtered and removed by the circumferential wall 32 and the bottom wall 33 which are the mesh-like filtering portion of the filter body 31 engaged with the liquid suction port 16. Therefore, no foreign objects are sucked into the pump chamber 11B of the washer pump 10. Accordingly, damage of the impeller 22 caused when foreign objects are mixed into the washing liquid W and blinding of the nozzle 9 can be positively prevented.

As described above, the filter body 31 of the filter 30 for filtering washing liquid W is engaged with the liquid suction port 16 of the washer pump 10, and the duct portion 34, which is an air passage, is integrally formed in this filter body 31, and this duct portion 34 is communicated with the pump chamber 11B via the ventilation hole 12*f* formed on the bottom wall 12*c* which partitions the pump chamber 11B of the washer pump 10 and the liquid suction port 16. Due to the foregoing, even if a water film is formed on the filter body 31, when the pump chamber 11B is made into a state of negative pressure by letting air out from the pump chamber 11*b* into the washer tank 5 via the ventilation hole 12*f* and the duct portion 34, it is possible to tear away the water film formed on the filter body 31. Due to the foregoing, washing liquid W can be positively sucked into the pump chamber 11B and discharged out from the liquid discharge port 18.

Between the bottom wall 12*c*, which partitions the motor chamber 11A of the washer pump 10 and the pump chamber 11B, and the circumferential wall 13*a* of the pump cover 13, a pair of chambers 19, 19 are formed, and the inside ventilation hole 12*h*, which communicates with the motor chamber 11A penetrating the bottom wall 12*c* on the upper face 19*a* of each chamber 19, is formed, and a plurality of outside ventilation holes 13*h*, which communicate with the outside air, are respectively formed in the outer circumferential portion of the bottom wall 13*c* of the pump cover 13 located at a lower portion in the axial direction with respect to the outer circumferential edge of the bottom wall 12*c* of the lower face 19*b* of each chamber 19. Therefore, even when the case 11 of the washer pump 10 is covered with water in all directions, the water stays in each chamber 19. Further, a labyrinth structure is formed in such a manner that each inside ventilation hole 12*h* is formed inside in the radial direction with respect to each outside ventilation hole 13*h*. Therefore, it is possible to positively prevent the water from entering the motor chamber 11A.

Concerning the bottom wall 12*c* on the upper face 19*a* of the chamber, the upper face 12*i* is formed into an inclined face. Even when water enters the motor chamber 11A, the water is guided by the upper face 12*i* of the bottom wall 12*c*, which is formed on the inclined face, and moves into each inside ventilation hole 12*h* and enters each chamber 19. Therefore, even when water gets into the motor chamber 11A, the water can be quickly discharged from the motor chamber 11A.

The lower face 19*b* of the chamber is formed into an inclined face in such a manner that when the lower face 19*b* comes close to the outer circumference of the bottom wall 12*c*, a distance from the lower face 19*b* to the upper face 19*a* of the chamber is increased. Therefore, water staying in each chamber 19 is guided by the lower face 19*b* of the chamber and drops downward and is positively discharged outside via each outside ventilation hole 13*h*.

In the above embodiment, the semicylindrical duct, which is used-as an air passage, is integrally formed in the filter body of the filter, however, a cylindrical ventilation tube may be formed in the filter body so that it can be used as an air passage.

According to the washer pump described in claim 1, 2 or 3, a ventilation hole is provided on the partition wall to partition the pump chamber and the liquid suction port, a filter for filtering the washing liquid is detachably attached to the liquid suction port, an air passage is provided in the filter, and the air passage is communicated with the ventilation hole. Therefore, even if a water film is formed on the filter, when the pump chamber is made into a state of negative pressure by letting air out from the pump chamber via the ventilation hole and the air passage, it is possible to tear away the water film formed in the filter. Due to the foregoing, the washing liquid can be sucked into the pump chamber and positively discharged from the liquid discharge port.

According to the filter used for the washer pump of the invention described in claim 4, 5 or 6, a filter body for filtering the washing liquid is detachably attached to the liquid suction port, an air passage is provided in the filter body, and the air passage is communicated with a ventilation hole provided on a partition wall for partitioning the pump chamber and the liquid suction chamber. Therefore, even if a water film is formed on the filter body, when the pump chamber is made into a state of negative pressure by letting air out from the pump chamber via the ventilation hole and the air passage, it is possible to tear away the water film formed in the filter. Due to the foregoing, the washing liquid can be sucked into the pump chamber and positively discharged from the liquid discharge port.

What is claimed is:

1. A washer pump comprising:

a case which is partitioned into a motor chamber and a pump chamber by a partition wall at one end of a cylindrical pump case;

an armature accommodated in the motor chamber, the armature having an armature shaft rotatable when the armature is electrically energized;

an impeller accommodated in the pump chamber and coupled to the armature shaft so as to be rotatable;

a liquid suction port in a circumferential wall of said cylindrical pump case and communicating with the pump chamber from which washing liquid is sucked into the pump chamber by a rotation of the impeller; and a filter detachably attached in the liquid suction port for filtering the washing liquid, wherein a ventilation hole is formed in said partition wall between the pump chamber and the liquid suction port, so that an air passage communicating with the ventilation hole is provided in the filter.

2. A washer pump according to claim 1, wherein the filter is provided with a filter body having a cylindrical circumferential wall and a bottom wall, each of the bottom wall and the cylindrical circumferential wall of the filter body being formed with mesh-like filtering portions, and a part of the cylindrical circumferential wall is formed into a duct portion functioning as an air passage extending in the longitudinal direction of the filter.

3. A washer pump according to claim 2, wherein the duct portion is extended from an opening side of the filter so as to protrude from the bottom wall, and a cutout portion formed on a bottom face of the duct portion at a side thereof is made to closely come into contact with an attachment portion having flat faces in a stepped manner in the liquid suction port.

4. A filter adapted to be installed in a washer pump including a case partitioned into a motor chamber which accommodates an armature having an armature shaft that is rotatable when the armature is electrically energized, and a pump chamber which accommodates dates an impeller that is coupled to the armature shaft of the armature so as to be rotatable, wherein washing liquid is sucked into the pump chamber from a liquid suction port, which communicates with the pump chamber by the rotation of the impeller, and the washing liquid is discharged from a liquid discharge port which is communicated with the pump chamber, the filter comprising:

a filter body detachably attached to the liquid suction port and defining an air passage that communicates with a ventilation hole provided on a partition wall that partitions the pump chamber from the motor chamber.

5. A filter used for a washer pump described in claim 4, wherein the filter body includes a substantially cylindrical circumferential wall and a bottom wall, each of the circumferential wall and the bottom wall being formed into a mesh-like filtering portion, and a part of the circumferential wall is formed into a duct portion functioning as an air passage extending in the longitudinal direction of the filter.

6. A filter used for a washer pump described in claim 5, wherein the duct portion is extended from an opening side of the filter so as to protrude from the bottom wall, and a cutout portion formed on a bottom face of the duct portion at a side thereof is made to closely come into contact with an attachment portion of said liquid suction port having flat faces in a stepped manner in the liquid suction port.

7. A washer pump comprising:

a case having a partition wall that partitions a motor chamber from a pump chamber, wherein said partition wall defines a ventilation hole from said pump chamber to said motor chamber, and further comprising a filter comprising a filter wall defining a duct that communicates with said ventilation hole.

8. The pump of claim 7, wherein said filter wall comprises a cylindrical circumferential wall.

9. The pump of claim 8, wherein said filter wall further comprises an end face.

10. The pump of claim 9, wherein said duct extends from an inlet side of said filter beyond said end face of said filter wall.

11. The pump of claim 10, wherein said duct comprises duet walls that include a stepped portion that steps radially inwardly at an end of said duct that is toward said end face of said filter wall.

12. The pump of claim 11, wherein said case defines a liquid suction port in a circumferential wall of said case on said motor chamber side of said partition wall.

13. The pump of claim 12, wherein said partition wall defines at least a portion of said liquid suction port.

14. The pump of claim 13, wherein said ventilation hole extends through said partition wall into said liquid suction port.

15. The pump of claim 12, wherein said filter is detachably attached within said liquid suction port, and wherein said stepped portion closely contacts an attachment portion of said liquid suction port.

16. The pump of claim 15, wherein said attachment portion and said stepped portion each comprise matching flat faces.

17. The pump of claim 7, wherein said duct extends in a longitudinal direction of said filter.

18. A washer pump comprising:

a case having a partition wall that partitions a motor chamber from a pump chamber, wherein said partition wall defines a ventilation hole from said pump chamber to said motor chamber and, further comprising a filter defining a cylindrical ventilation tube in communication with said ventilation hole.

* * * * *